US007031797B2

(12) United States Patent
Reinschke et al.

(10) Patent No.: US 7,031,797 B2
(45) Date of Patent: Apr. 18, 2006

(54) COMPUTER-AIDED METHOD FOR DETERMINING DESIRED VALUES FOR CONTROLLING ELEMENTS OF PROFILE AND SURFACE EVENNESS

(75) Inventors: Johannes Reinschke, Erlangen (DE); Friedemann Schmid, Erlangen (DE); Marco Miele, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/507,649

(22) PCT Filed: Mar. 3, 2003

(86) PCT No.: PCT/DE03/00716

§ 371 (c)(1),
(2), (4) Date: Sep. 10, 2004

(87) PCT Pub. No.: WO03/078086

PCT Pub. Date: Sep. 25, 2003

(65) Prior Publication Data

US 2005/0125091 A1 Jun. 9, 2005

(30) Foreign Application Priority Data

Mar. 15, 2002 (DE) ..... 102 11 623

(51) Int. Cl.
*B21B 37/28* (2006.01)
*G06F 19/00* (2006.01)

(52) U.S. Cl. ..... 700/150; 700/148; 700/153; 700/155; 72/7.1; 72/9.1; 72/9.2; 72/10.4; 72/11.7; 72/11.8

(58) Field of Classification Search ..... 700/148, 700/150, 153, 155; 72/7.1, 9.1, 9.2, 10.4, 72/11.7, 11.8
See application file for complete search history.

(56) References Cited

U.S. PATENT DOCUMENTS 6,427,507 B1 * 8/2002 Hong et al. ..... 72/9.1
6,526,328 B1 * 2/2003 Maguin et al. ..... 700/148

(Continued)

FOREIGN PATENT DOCUMENTS

DE 198 44 305 A1 3/2000
DE 198 51 554 A1 5/2000

(Continued)

OTHER PUBLICATIONS

"A Model for the Simulation of a Cold Rolling Mill, Using Neural Networks and Sensitivity Factors" -Zarate, Luis—Pontifica Universidade Catolica de Minal Gerais, IEEE 2000.*

(Continued)

*Primary Examiner*—Leo Picard
*Assistant Examiner*—Michael D. Masinick

(57) ABSTRACT

Input variables, which describe a metal strip prior to and after the passage of a rolling stand, are fed to a material flow model. The material flow model determines online a rolling force progression in the direction of the width of the strip and fees said progression to a roller deformation model. The latter determines roller deformations from said progression and feeds them to a desired value calculator, which calculates the desired values for the controlling elements of profile and surface evenness using the calculated roller deformations and a contour progression on the runout side.

24 Claims, 6 Drawing Sheets

U.S. PATENT DOCUMENTS

| | | | | |
|---|---|---|---|---|
| 6,948,346 | B1 * | 9/2005 | Pawelski | 72/7.1 |
| 2004/0205951 | A1 * | 10/2004 | Kurz et al. | 29/407.05 |

FOREIGN PATENT DOCUMENTS

| | | | |
|---|---|---|---|
| EP | 0 988 903 | A1 | 3/2000 |
| EP | 1 181 992 | A2 | 2/2002 |

OTHER PUBLICATIONS

Galvez, J. M., Zarate, Luis E. and Helman, H. A model-based predictive control scheme for steal rolling mills using neural networks. J. Braz. Soc. Mech. Sci. & Eng., Jan./Mar. 2003, vol. 25, No. 1, p. 85-89. ISSN 1678-5878.*

"Neural Control of a Steel Rolling Mill" -Sbarbaro-Hofer et al, IEEE, Jun. 1993.*

Dietmar Auzinger, Martina Pfaffermayr, Rudolf Pichler, Bernhard Schlegl, "Advanced Process Models for Today's Hot Strip Mills", SEAISI 1995 Conference of the South East Asia Iron and Steel Institute, Penang/Malaysia, May 22-24, 1995, pp. 58-60, 62-64. (Cite No. 5 is Corresponding English Translation of Cite No. 7).

Olof Wiklund, Jonas Edberg, Nils-Goran Jonsson and Jan Leven, "Profile and Flatness Control Methods for Rolling of Flat Products Simulated with MEFOS'S Physically Based Computer Models", 33rd MWSP Conference Proceedings, ISS-AIME, vol. XXIX, 1992, pp. 363-369.

Dietmar Auzinger, Martina Pfaffermayr, Rudolf Pichler and Bernhard Schlegl, "Neue Entwicklungen BEI Prozessmodellen Fuer Wermbreitbandstrassen", Stahl und Eisen, Verlag Stahleisen GMBh, Dusseldorf, Germany, vol. 116, No. 7, Jul. 15, 1996, pp. 59-65, 131, XP000629440.

Y. Saab, "Interative Methods for Sparse Linear Systems", PWS Publishing Company, 1996. (BOOK).

Fachbuch, "Contact Mechanics", von K. L. Johnson, Cambridge University Press, 1995. (BOOK).

R. Barrett, M. Berry, T.F. Chan, J. Demmel, J. Donato, J. Dongarra, V. Eljkhout, R. Pozo, C. Romine and H. Van Der Vorst, Templates for the Solution of Linear Systems: Building Blocks for Iterative Methods, Software—Environments—Tools, SIAM, 1994. (BOOK).

Fachbuch, "High Quality Steel Rolling—Theory and Practice", von Vladimir B. Ginzburg, Marcel Dekker Inc., New York, Basel, Hong Kong, 1993. (BOOK).

Robert E. Johnson, "Shape Forming and Lateral Spread in Sheet Rolling", Int. J. Mech. Sci. vol. 33, No. 6, 1991, pp. 449-469.

* cited by examiner

COMPUTER-AIDED METHOD FOR DETERMINING DESIRED VALUES FOR CONTROLLING ELEMENTS OF PROFILE AND SURFACE EVENNESS

CROSS REFERENCE TO RELATED APPLICATIONS

This application is the US National Stage of International Application No. PCT/DE03/00716, filed Mar. 3, 2003 and claims the benefit thereof. The International Application claims the benefits of German application No. 10211623.7 filed Mar. 15, 2002, both of the applications are incorporated by reference herein in their entirety.

FIELD OF INVENTION

This invention relates to a computer-aided method for determining desired values for controlling elements of profile and surface evenness of a rolling frame (or rolling stand) with at least work rollers for rolling metal strip that extends in one direction of the width of the strip. The metal strip can, for example, be a steel strip, an aluminum strip or a non-ferrous heavy metal strip, in particular a copper strip.

BACKGROUND OF INVENTION

Conventional methods enable the rolled strip to have a desired finishing temperature and a desired final thickness.

The quality of the rolled strip is, however, not determined exclusively by these variables. Furthermore, the variables determining the quality of the rolled metal strip are, for example, the profile, the contour and the surface evenness of the metal strip.

The terms profile, contour and surface evenness are to some extent used with different meanings in the prior art.

For example, in the actual lexical meaning, profile means the progression of the thickness over the width of the strip. But according to prior art the term is used not only for the progression of the thickness of the strip over the width of the strip but also sometimes as a purely scalar dimension for the deviation of the thickness of the strip at the edges of the strip from the thickness of the strip in the center of the strip. The term profile value is used for this value in the following.

The term contour sometimes means the absolute progression of the strip thickness, sometimes the absolute progression of the strip thickness less the thickness of the strip in the centre. The term contour progression is used in the following to mean the progression of the strip thickness less the thickness of the strip in the center of the strip.

In its lexical meaning, the term surface evenness includes mainly only visible deformations of the metal strip. According to prior art, and also in the context of this invention, it is however used as a synonym for the internal stresses in the strip, regardless of whether or not these internal stresses lead to visible deformations of the metal strip.

According to prior art, different methods for the control of the surface evenness of metal strips are already known. One such method is, for example, known from DE 198 51 554 C2. However, these methods do not work completely satisfactorily. In particular, the pre-setting and the maintenance of a preset surface evenness is sometimes difficult.

SUMMARY OF INVENTION

The object of the invention is to create a computer-aided method of determination for desired values for controlling elements of profile and surface evenness, by means of which the preset profile values, contour progressions and/or surface evenness progressions can be achieved and maintained better than according to prior art.

This object is achieved in that

- input variables are fed to a material flow model that describes the metal strip before and after the passage of the rolling frame,
- the material flow model determines online at least one rolling force progression at least in the direction of the width of the strip and feeds said progression to a roller deformation model,
- the roller deformation model uses the rolling force progression to calculate the resulting roller deformations and feeds them to a desired value calculator and
- the desired value calculator calculates the desired values for the controlling elements of profile and surface evenness using the calculated roller deformations and a contour progression on the runout side.

The material flow model calculates a two-dimensional distribution of the roller force with one direction extending in the rolling direction and the other in the direction of the width of the strip. It is possible to transfer the two-dimensional distribution of the rolling force directly to the roller deformation model. It is, however, usually sufficient if the material flow model calculates the rolling force progression in the direction of the width of the strip by integration of the distribution of the roller force in the rolling direction.

If the metal strip and the input variables are symmetrical in the direction of the width of the strip, the computing effort for calculating the rolling force progression can be reduced.

In hot rolling the so-called Hitchcock formula applies, according to which the roll gap length can be calculated and in accordance with which the roll gap geometry remains essentially arc-shaped despite the deformation of the work rollers in the rolling direction. In conjunction with the contour progression at the roll gap entrance and exit, the complete two-dimensional roll gap progression, i.e. both in the direction of the strip width and in the rolling direction, can therefore be approximately calculated. The input variables therefore preferably include at least one starting contour progression, a final contour progression and a starting surface evenness progression.

If the material flow model calculates the roller force in the direction of the strip width using at least one mathematical-physical differential equation that describes the flow behavior of the metal strip in the roll gap, the material flow model works with particular accuracy. The calculation of the roller force progression then takes place using the deformation processes that actually take place between the work rollers.

The metal strip is rolled in the rolling frame in the rolling direction from a roll gap start over an effective roll gap length. If a roll gap ratio is substantially less than one, whereby the roll gap ratio of the quotient is half the incoming strip thickness and the effective roll gap length, then at least one differential equation can be approximately solved with little computing effort. The roll gap ratio should thus be less than 0.4, if possible less than 0.3, e.g. less than 0.2 or 0.1.

If the roll gap ratio is small, it is possible to take account of only leading terms of the roll gap ratio in the at least one differential equation, i.e. to form an asymptotic approximation. The coefficients of the at least one differential equation thus vary only in two dimensions instead of in three dimensions. The computing effort to solve the at least one differential equation can therefore be substantially reduced.

The computing effort with the same accuracy being achieved can be still further reduced if the at least one differential equation is defined at support points in the rolling direction and direction of the strip width and the support points are unequally distributed. Alternatively, an increase in the achieved accuracy can also be obtained instead of reducing the computing effort. In particular, the support points in this case could be evenly distributed in the rolling direction and arranged closer together towards the edge of the strip than in the area of the center of the strip in the direction of the strip width.

If a friction coefficient in the rolling direction and a friction coefficient in the direction of the strip width are included in the at least one differential equation, the friction coefficient is constant in the rolling direction and the friction coefficient in the direction of the strip width is a non-constant function, a substantially higher accuracy is achieved than if the friction coefficient in the direction of the strip width is constant.

The metal strip has different material properties, particularly flow stress. Only slightly poorer computing results are obtained with a substantially reduced computing effort if the flow stress is assumed to be constant in the context of the material flow model and/or only plastic deformations of the metal strip are allowed for by the material flow model.

If the material flow model also calculates an anticipated runout end surface evenness progression of the metal strip in the direction of the width of the strip, it then provides even more comprehensive information.

If the roller deformation model has a work roller flattening model and a residual rolling deformation model, a flattening progression of the work rollers for the metal strip is calculated by using the work roller flattening model and the remaining deformations of the rollers of the rolling frame are calculated by means of the residual rolling deformation model and the rolling force progression is fed exclusively to the work roller flattening model, this is normally sufficient for calculating the desired values. More accurate results can, of course, be obtained with an increasing computing effort if the rolling force pattern is also fed to the residual rolling deformation model.

The material flow model is preferably adapted using the rolled metal strip. For this, for example, at least one of the friction coefficients relative to the actual contour progression and/or surface evenness progression determined by measurement and to the contour pattern and/or surface evenness pattern expected on the basis of the material flow model, can be varied. In a rolling train, the measurement can be taken after any rolling frame.

In principle any metal strip can be rolled by means of the rolling frame. Preferably, however, a steel strip or aluminum strip is hot rolled.

A rolling train with several rolling frames where the method of calculation in accordance with the invention is used has preferably at least three rolling frames, with the calculation method in accordance with the invention being applied to each of the rolling frames.

Further advantages and details are given in the following description of an exemplary embodiment, with the aid of illustrations and further claims. The illustrations are as follows.

BRIEF DESCRIPTION OF THE DRAWINGS

Figure 1:
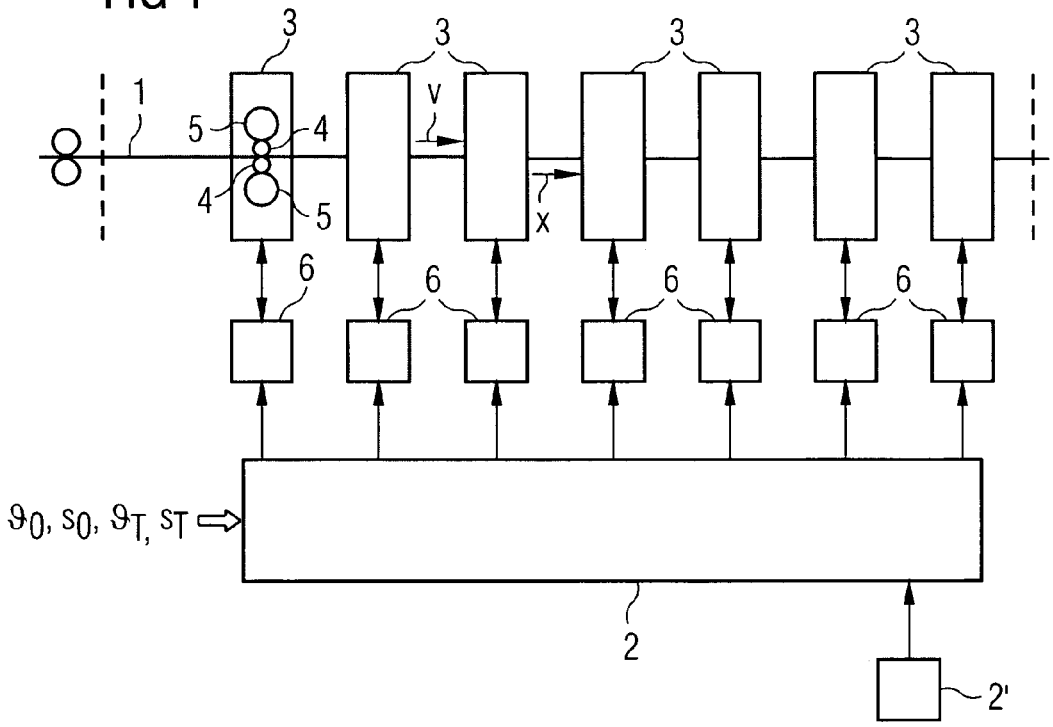
Figure 2A:
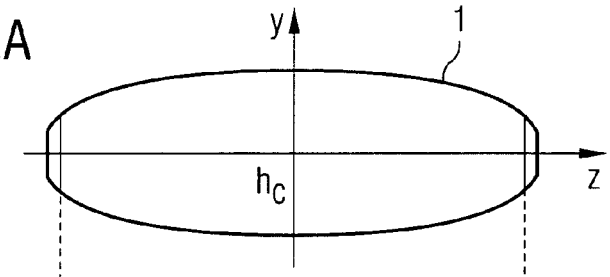
Figure 2B:
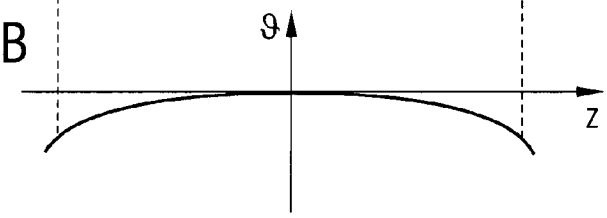
Figure 3A:
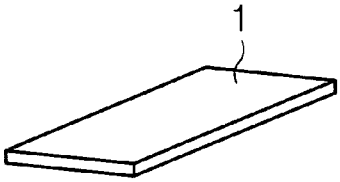
Figure 3B:
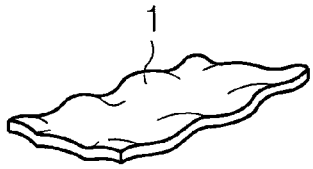
Figure 3C:
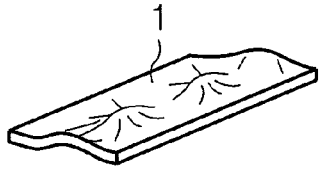
Figure 4:
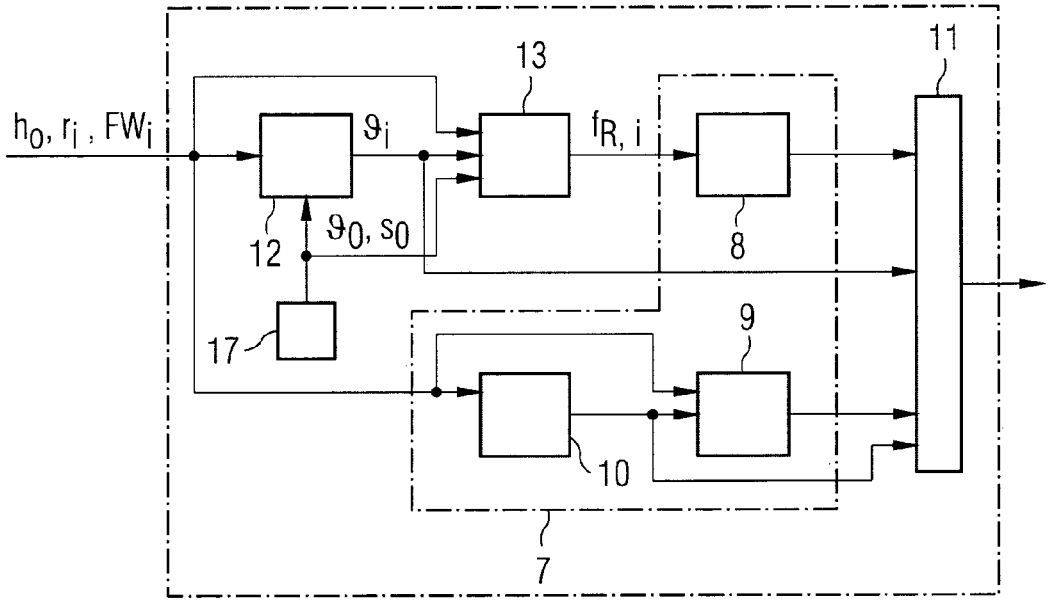
Figure 5:
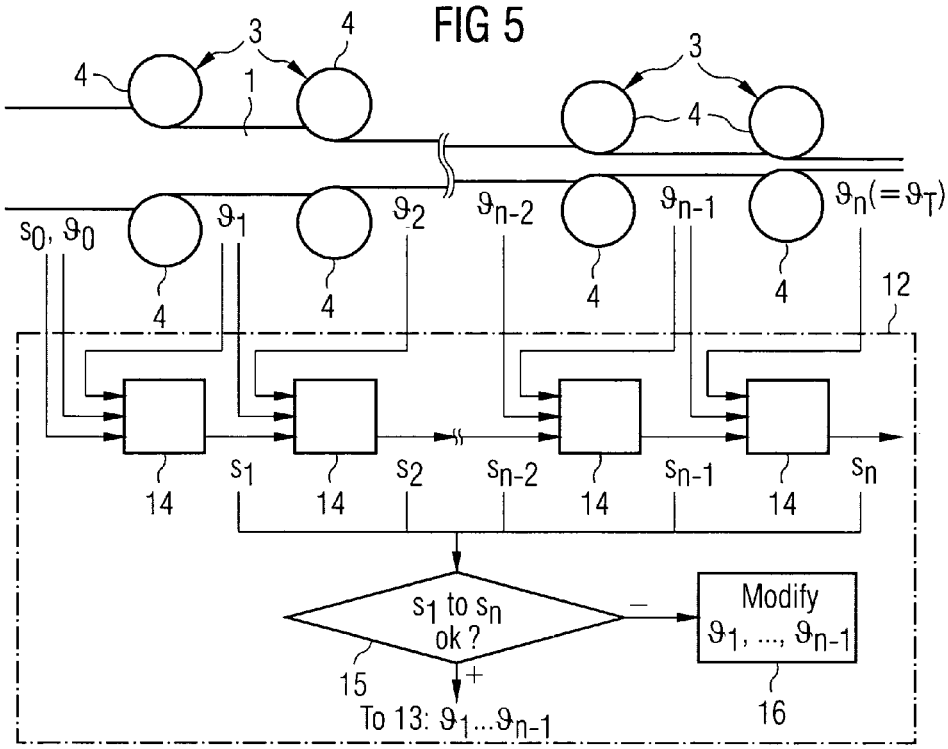
Figure 6:
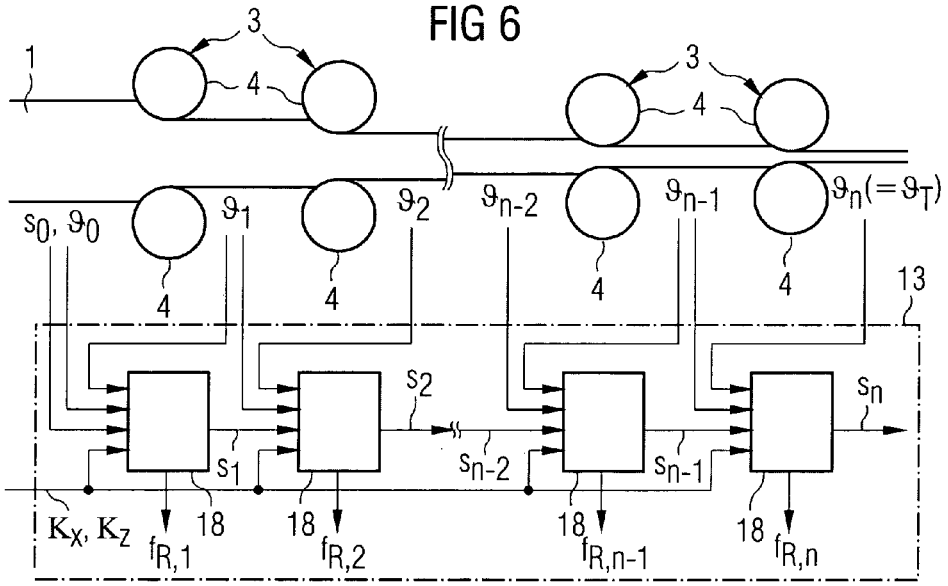
Figure 7:
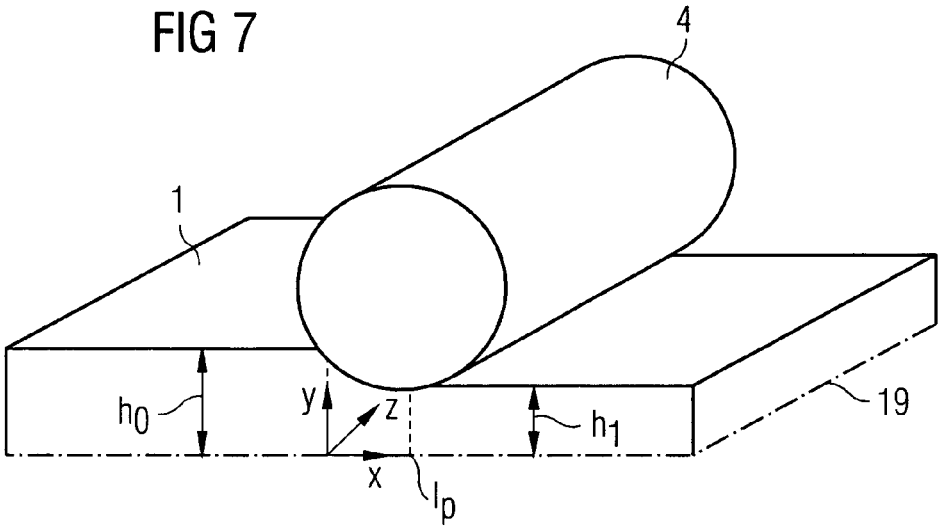
Figure 8:
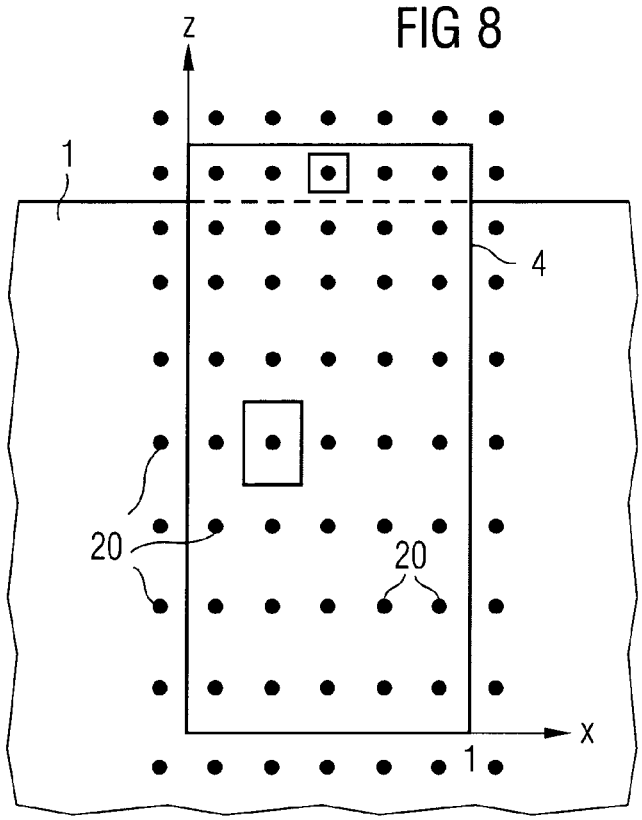
Figure 9:
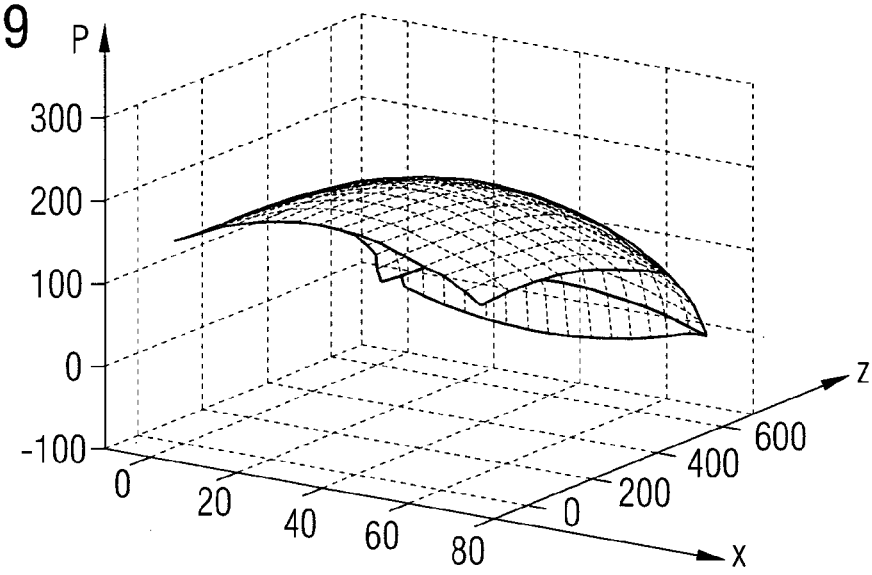
Figure 10:
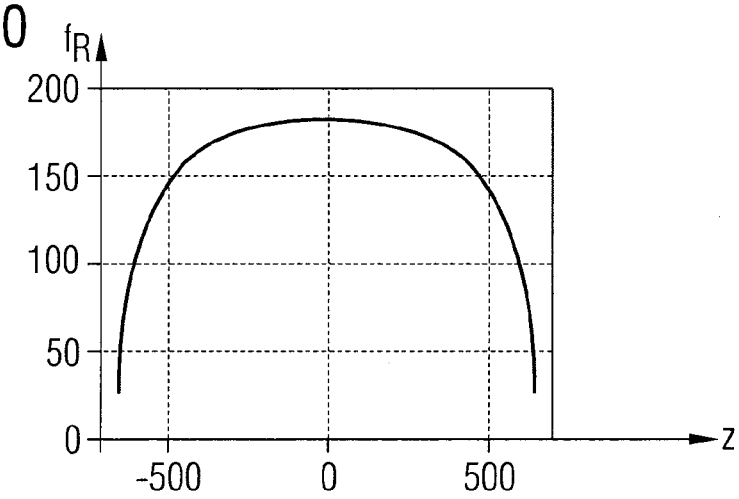
Figure 11:
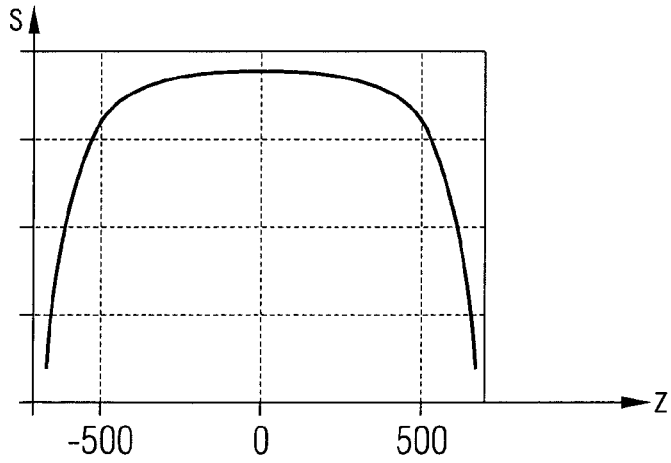
Figure 12:
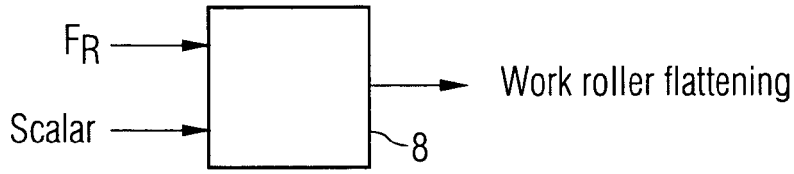
Figure 13:
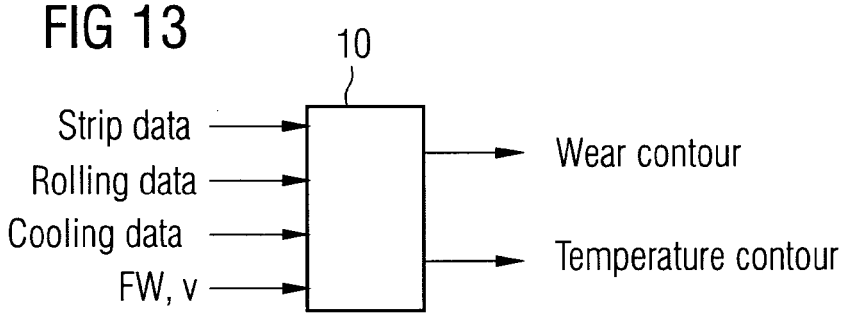
Figure 14:
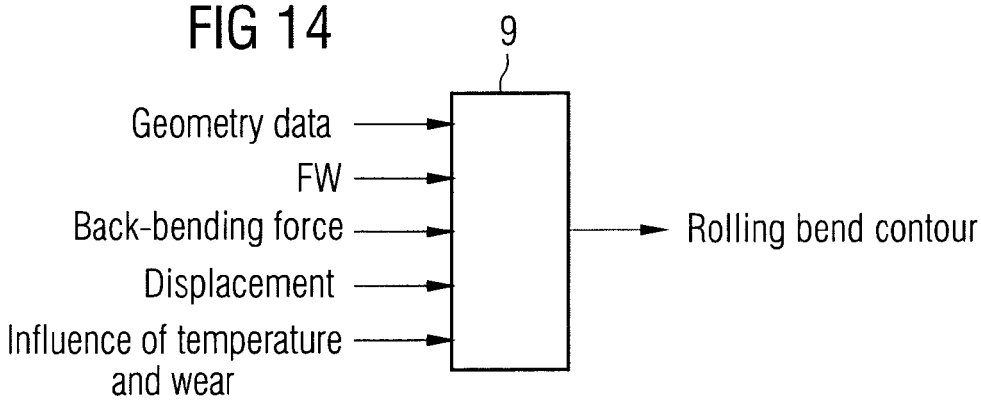
Figure 15:
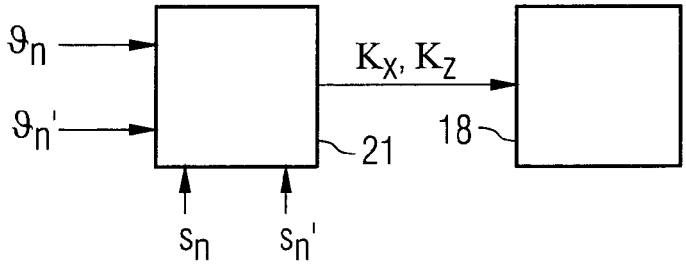

| | |
|---|---|
| FIG. 1 | A multi-frame rolling train for rolling metal strip, controlled by a control computer |
| FIGS. 2a and 2b | A metal strip showing the cross-section and a contour progression |
| FIGS. 3a to 3c | Various metal strips |
| FIG. 4 | A block diagram of the models implemented in the control device. |
| FIG. 5 | A contour calculator |
| FIG. 6 | A strip deformation model |
| FIG. 7 | A work roller and the top half of a metal strip |
| FIG. 8 | A plan view of the metal strip |
| FIG. 9 | A two-dimensional distribution of the roller force |
| FIG. 10 | A rolling force progression in the direction of the width of the strip |
| FIG. 11 | A surface evenness progression of the metal strip |
| FIG. 12 | A work roller flattening model |
| FIG. 13 | A rolling temperature and wear model |
| FIG. 14 | A rolling bending model |
| FIG. 15 | A schematic of an adaptation method. |

DETAILED DESCRIPTION OF INVENTION

FIG. 1 shows a rolling train for rolling metal strip 1 controlled by a control computer 2. The operation of the control computer 2 is determined by a computer program product 2' by means of which the control computer 2 is programmed. The rolling train, shown in FIG. 1, has seven rolling frames 3, i.e. in particular at least three rolling frames 3. The metal strip 1 is rolled in a rolling direction x in the rolling train.

The rolling train in FIG. 1 is designed as a production line for hot-rolling steel strip. This invention is, however, not limited to the application in a multi-frame production line for hot-rolling steel strip. Instead, the rolling train can also be designed as a cold-rolling train (tandem train) and/or have only one rolling frame (e.g. a reversing frame) and/or be designed for rolling a non-ferrous metal (e.g. aluminum, copper or a different non-ferrous heavy metal).

The rolling frames 3 have at least work rollers 4 and, as shown in FIG. 1 for one of the rolling frames 3, also normally backup rolls 5. They can also have even more rollers, for example axially-moveable intermediate rollers.

Desired values for controlling elements (not illustrated) of profile and surface evenness are provided by the control computer 2 to frame controllers 6. The frame controllers 6 control the controlling elements according to the preset desired values.

By means of the desired values, a runout roll gap progression, that is established between the work rollers 4, is influenced for each rolling frame 3. The roll gap progression at the runout end corresponds to the runout contour pattern θ of the metal strip 1. The desired values for the controlling elements must therefore be determined in such a way as to produce this roll gap progression.

The input variables fed to the control computer 2 include, for example, roll pass plan data such as the initial thickness $h_0$ of the metal strip 1 as well as a total rolling force FW (referred to in the following as rolling force) for each rolling frame 3 and a pass reduction r. It usually also includes a final thickness $h_n$, a desired profile value, a desired contour progression $\theta_T$ and a required surface evenness progression $S_T$. The rolled metal strip 1 should usually be as flat as possible. The control computer 2 determines the desired values from input variables that are fed to it and that describe the metal strip 1 at the input and output end.

The metal strip 1, as shown in FIG. 2*a*, does not usually have a completely uniform strip thickness $h_0$ in the direction of the strip width z. Therefore the contour progression θ is usually defined in the strip width direction z in addition to the strip thickness $h_0$, in that the strip thickness in the center of the metal strip 1 is subtracted from the actual strip thickness present at the particular points in the direction of the strip width z. An example of a contour progression θ of this kind is shown in FIG. 2*b*.

Furthermore, the metal strip 1 should ideally be absolutely even after rolling, as shown schematically in FIG. 3*a*.

Frequently, however the metal strip 1 has distortions as shown in FIGS. 3*b* and 3*c*. The cause of such distortions is internal stress differences in the direction of the strip width z, that are caused by uneven rolling over the width of the strip.

Even when the metal strip 1 is distortion-free, internal stress differences are usually present. A function in the direction of the strip width z that is characteristic of the internal stress distribution in the metal strip 1 is shown in the following as a surface evenness progression s.

The desired roll gap progressions should therefore be determined in the rolling frames 3 as far as possible to make sure that the metal strip 1 achieves the desired finished rolled sizes. The control computer 2 therefore implements several interacting blocks in accordance with the computer program product 2'. This is explained in more detail in the following, with the aid of FIG. 4.

With aid of the computer program product 2' shown in FIG. 4, a work roller flattening model 8, a rolling bending model 9, a finishing temperature and wear temperature model 10 and a desired value calculator 11 are implemented in the control computer 2. The work roller flattening model 8, the rolling bending model 9 and the finishing temperature and wear model 10 together form a roller deformation model 7. The computer program product 2' in the control computer 2 also has a contour calculator 12 and a strip deformation model 13.

The contour calculator 12 is line-specific. As shown in FIG. 5, each rolling frame 3 has a (frame-specific) surface evenness estimator 14. Each surface evenness estimator 14 is supplied with an input and output contour progression θ and an input surface evenness progression s. The contour progressions θ between the rolling frames 3 are initially only provisional. They are later modified if necessary. The following frame-specific variables are also fed to each surface evenness estimator 14.

An initial strip width and an initial strip thickness.

A strip input tension $\sigma_0$ before and a strip output tension $\sigma_1$ after each particular rolling frame 3.

The radii of the work rollers 4 and the modulus of elasticity of the work rollers 4.

The rolling force FW and pass reduction r.

The coefficients of friction $\kappa_x$, $\kappa_z$.

The surface evenness estimators 14 determine online an estimation of the anticipated surface evenness progression s in the direction of the strip width z at the runout of the relevant rolling frame 3. The surface evenness progression s for the rolling frames 3 downstream of the first rolling frame 3 cannot therefore be estimated until the preceding surface evenness estimators 14 have already made the assessments of the surface evenness progressions s at the outlet of the rolling frame 3 assigned to it. The internal construction and the configuration of the surface evenness estimators 14 is dealt with in more detail in the following.

In a test block 15, a check is carried out to determine whether the determined surface evenness progressions s are correct. In particular, it is checked whether the determined surface evenness progressions s lie between the upper and lower barriers su. The upper and lower barriers su thus frame the desired surface evenness progression $S_T$ for the last rolling frame 3.

If the determined surface evenness progressions s depart from the barriers su, so, the contour progressions θ are modified in a modification block 16. The contour progression $\theta_0$ before the first rolling frame 3 and the contour pattern $\theta_T$ after the last rolling frame 3 that should be reached are in this case not changed. The varied contour progressions θ are again fed to the surface evenness estimators 14 that then recalculate the surface evenness progressions s after the rolling frames 3. If on the other hand the surface evenness progressions s are correct, the established contour progressions θ are fed to the strip deformation model 13 according to FIG. 4.

The surface evenness estimators 14 are thus called up repeatedly. This is possible because the surface evenness estimators 14 estimate the surface evenness progressions s quickly enough to be able to perform this iteration online.

As shown in FIG. 4, the contour progression $\theta_0$ at the inlet of the first rolling frame 3 and the corresponding surface evenness progression $s_0$ from a function generator 17 are given. The corresponding progressions $\theta_0$, $s_0$ are thus given independent of the corresponding actual initial progressions of the metal strip 1. This is possible because both progressions $\theta_0$, $s_0$ are non-critical for production lines with at least five rolling frames 3. Typically, the initial contour progression $\theta_0$ can, for example, be given as a quadratic function of the width in the direction of the strip z, so that the thickness of the strip d at the edges of the strip is 1% less than in the center of the strip. The surface evenness progression $S_0$ at the inlet of the first rolling frame 3 can be assumed to be identical to 0. For rolling trains for non-ferrous metals (aluminum, copper etc.), both progressions $\theta_0$, $s_0$ can be uncritical even for three rolling frames 3. Alternatively, the actual contour and surface evenness progressions $\theta_0$, $s_0$ at the inlet of the rolling train can of course be determined using a measuring device and fed to the contour estimator 12 and strip deformation model 13.

The determined contour progressions θ are fed to the strip deformation model 13 in accordance with FIG. 4, to determine the rolling force progressions $f_R(z)$ in the direction of the strip width z for the individual rolling frames 3. The strip deformation model 13 is specific to the production line. It is divided into material flow models 18 as shown in FIG. 6, with each material flow model 18 being assigned to a rolling frame 3. The same variables are fed to each material flow model 18 as to the corresponding surface evenness estimator 14.

The material flow models 18 model, online, the physical behavior of the metal strip 1 in the roll gap. This is further explained in the following with the aid of FIG. 7 to 11.

FIG. 7 shows the metal strip 1 in rolling frame 3 being rolled in the rolling direction x from a roll gap entry over an effective roll gap length $l_p$. The origin of a system of coordinates is placed in a strip center plane, according to FIG. 7. The strip center plane 19 runs parallel to the rolling direction x and parallel to the direction of the strip width z. The metal strip 1 extends in the direction of the strip thickness y above and below the strip center plane 19.

The behavior of the metal strip 1 in the roll gap can be described by a system of differential equations and algebraic equations. In particular, the equation system describes the flow behavior of the metal strip 1 in the roll gap. For example, the behavior of the metal strip 1 can be described by the equations described by R. E. Johnson in the technical article Shape Forming and Lateral Spread in Sheet Rolling, Int. J. Mech. Sci. 33 (1991), Pages 449 to 469.

In the equations, it can, for example, be assumed that the coefficient of friction $\kappa_x$ is constant in the rolling direction and the coefficient of friction $\kappa_z$ in the direction of the strip width z is a non-constant function.

Further given or assumed symmetries can be taken into account to reduce the computing effort. In particular, for example, it can be assumed that the metal strip 1 and the input variables (particularly the input contour progression $\theta_0$ and the input surface evenness progression $s_0$) are symmetrical in the direction of the strip width z. The material flow model 18 can also be configured without difficulty in such a way that it also includes the asymmetric case.

The equation system can thus be re-formulated. In particular, it is possible to reformulate the equations so that all variables and parameters are dimensionless. This is also already known from the technical article by Johnson, referred to above.

Thus, again in agreement with Johnson, the circumstance that the effective roll gap length $l_p$ is substantially greater than half the incoming strip thickness $h_0$ can be utilized. The roll gap ratio $\delta$ is thus substantially less than one. In this way, the equations (or their dimensionless modified pendants) can be developed with regard to the roll gap ratio $\delta$, whereby only leading terms are taken into account in the roll gap ratio $\delta$.

Further simplifying measures can also be taken. It can, for example, be assumed that the flow stress $\hat{\sigma}_F$ is a constant. It is also possible to take only plastic deformations of the metal strip 1 into account in the material flow model 18. This is permissible particularly for a hot-rolled metal strip 1.

By means of these simplifications, the equations can be re-formulated to form a single, partial differential equation including associated boundary conditions, that contains the dimensionless rolling pressure as a variable. The coefficients of this differential equation vary locally. One possible expression of this partial differential equation is also given in the aforementioned technical article by Johnson, as equation number 54 on page 457 of the article.

This differential equation is discretized by using finite volume methods. The differential equation is thus defined only at support points 20. The support points 20 are schematically shown in FIG. 8. Two of the finite volumes are included in FIG. 8 by way of example.

As can be seen from FIG. 8, the support points 20 are unevenly distributed. Although the support points 20 are equally distributed in the rolling direction x, in the direction of the strip width z they are arranged closer together near to the edges of the strip than in the area of the center of the strip.

By means of the finite volume discretizing of the partial differential equation, it is converted to a 'sparse' system of linear algebraic equations whose solution can be numerically calculated in a known manner by means of a bi-conjugated method of gradients. Examples of numerical solutions of such equations are given in the following.

Y. Saab: Iterative Methods for Sparse Linear Systems, PWS Publishing Company (1996) or R. Barrett, M. Berry, T. F. Chan, J. Demmel, J. Donato, J. Dongarra, V. Eijkhout, R. Pozo, C. Romine and H. van der Vorst: Templates for the Solution of Linear Systems: Building Blocks for Iterative Methods, Software—Environments—Tools, SIAM (1994).

By solving the partial differential equation or the algebraic equation system, a pressure distribution p(x,z), or a two-dimensional distribution p(x,z), of the rolling force FW is established from the material flow models 18 for each of the rolling frames 3 in turn. The directions in this case extend in the rolling direction x and in the direction of the strip width z. An example of an established two-dimensional distribution p(x,z) is shown in FIG. 9.

The rolling force progression $f_R(z)$ in the direction of the strip width z can be determined from the two-dimensional distribution p(x,z) of the rolling force FW by integration in the rolling direction x. An example of a rolling force progression $f_R$ of this kind is shown in FIG. 10.

Changes to the output speed of the metal strip 1 can be determined from the pressure progression p(x,z) by re-substitution. Solving the algebraic equation system thus also produces the expected surface evenness progression s in the direction of the strip width z at the outlet of the particular rolling frame 3. FIG. 11 shows an example of an expected surface evenness progression s(z) of this kind.

The flattening of the work rollers 4 to the metal strip 1 depends decisively on the rolling force progression $f_R(z)$ in the direction of the strip width z. The determined rolling force progression $f_R(Z)$ is therefore applied to the work roller flattening model 8 according to FIG. 4. A number of scalar parameters are also applied to the work roller flattening model 8 as shown in FIG. 12. These scalar parameters in particular include the strip width, the initial strip thickness, the pass reduction, the rolling force FW, the work roller radius and the modulus of elasticity of the surface of the work rollers 4.

A work roller flattening model 8 as such is known for example from the text book Contact Mechanics by K. L. Johnson, Cambridge University Press, 1995. This determines, in a known manner, a flattening progression of the work rollers 4 up to the metal strip 1 in the direction of the strip width z. The flattening progression is fed to the desired value calculator 11.

The finishing temperature and wear model 10 is, for example, also known from the text book High Quality Steel Rolling—Theory and Practice by Vladimir B. Ginzburg, Marcel Dekker Inc., New York, Basle, Hong Kong, 1993. It is fed, in a known manner, with data of the metal strip 1, rolling data, roll cooling data, rolling force FW and rolling speed v. The data of the metal strip 1, for example, includes the strip width, initial thickness, pass reduction, the temperature and thermal properties of the metal strip 1. The rolling data, for example, includes the geometry of the roll barrels and of the roll necks as well as the thermal properties and information on the bearings of the rollers.

A temperature contour (thermal crown) and a wear contour for all rollers 4, 5 of the particular rolling frame 3 is determined by means of the rolling temperature and wear model 10. Because the temperature and the wear of the rolls 4, 5 change over time, the rolling temperature and wear model 10 must be repeatedly called up, particularly at regular intervals. The interval between calls is normally in the order of between one and ten seconds, e.g. three seconds.

The rolling temperature and wear also depend inter alia on the rolling force progression $f_R$. Nevertheless, as shown in FIGS. 4 and 13, the rolling force progression $f_R$ determined from the material flow model 18 is not fed to the rolling temperature and wear model 10 because the influence of the rolling force progression $f_R$ is, although present, relatively small. In principle it would of course also be possible to feed the rolling force progression $f_R$ to the rolling temperature and wear model 10.

The temperature and wear contours determined from the rolling temperatures and wear model 10 are fed to the rolling bending model 9 in accordance with FIGS. 4 and 14. The rolling bending model 9 is also supplied with geometric data of rollers 4, 5, i.e. the rolling force FW, a back-bending force and, if appropriate, a rolling displacement. The rolling data particularly includes the geometric data of rollers 4, 5 including possibly a macrograph, the moduli of elasticity of the roll cores and of the roll shells for all rollers 4, 5 of the rolling frame 3.

The rolling bending model 9, as such, is also known, for example from the already mentioned text book by Vladimir B. Ginzburg. The rolling bending model 9 determines, in a known manner, all elastic deformations with the exception of the elastic flattening of the work rollers 4 to the metal strip 1, i.e. sagging and flattening of rollers 4, 5 for the particular rolling frame 3.

The work rolling bending contour determined in this also depends on the rolling force progression $f_R$ in the direction of the strip width z. Nevertheless, as shown in FIGS. 4 and 14, the rolling force progression $f_R$ is not supplied to the rolling bending model 9. This is possible because it is generally quite sufficient to assume that the rolling force $f_R$ in the direction of the strip width z is, in the context of the rolling bending model 9, uniform or at least uniform in the center and drops to zero at the edges. In this case also it would again be possible in principle to feed the rolling force progression $f_R$ calculated from the material flow model 18 to the rolling bending model 9.

The contours determined from the rolling bending model 9 and from the rolling temperature and wear model 10 are fed to the desired value calculator 11 as in FIG. 4. The desired value calculator 11 then also receives the strip thickness progression θ. The desired value calculator 11 can thus determine what residual rolling contour must still be realized by the profile and surface level controlling elements for each rolling frame 3, by differentiation between the contour progression θ at the runout side and the determined flattening and deformation of rollers 4, 5. The desired value calculator 11 can thus, in a known manner, e.g. by quadratic error minimization, determine the desired values for the controlling elements for profile and surface evenness and transmit these to the frame controllers 6.

The runout roll gap contour of the rolling frame 3 can be influenced by different actuators or correcting elements. For example the rolling back-bending, an axial rolling displacement for CVC rollers and a longitudinal twisting of the work rollers 4 (a setting of the work rollers 4 such that they are no longer aligned exactly parallel, a so-called pair crossing). A roll heating or cooling that acts only locally is also conceivable. The desired value calculator 11 can determine desired values for all these controlling elements.

The above assumes that the strip deformation model 13 has only a limited online capability. In particular, it was assumed that it is not possible to operate the material flow model 18 iteratively. The contour calculator 12 is necessary only in this case. The surface evenness estimator 14 has to be able to be called up several times for each rolling frame 3 in order to determine the correct contour progressions θ. If on the other hand the material flow model 18 has an iteration capability, the contour progressions θ and rolling force progressions $f_R(z)$, and also the profile progressions s, can be determined jointly and simultaneously by the material flow model 18.

If the surface evenness estimators 14 are required, they are designed as approximators that are derived from the material flow models 18 by simplified assumptions regarding the locally distributed input and output variables. For example, the contour and surface evenness progressions θ, s are described in the context of the surface evenness estimator 14 by lower-order polynomials in the direction of the strip width z. This leads to a reduction in the number of scalar input and output variables of the approximators to the necessary minimum with a degree of accuracy which is adequate with regard to the surface evenness estimators 14. The polynomials are preferably symmetrical polynomials of the fourth or sixth order.

Furthermore, the surface evenness estimators 14 in this case are, in contrast to the material flow models 18, not physical models. They can instead, for example, be tools with learning capability that were trained before use in the control computer 2. The training can take place offline or online. For example, the surface evenness estimators 14 can be designed as neural networks or as support vector models.

The material flow models 18 are preferably adapted using the rolled metal strip 1 and its actual (measured) contour progression θ and its actual surface evenness progression s'. In particular, it is possible, as shown in FIG. 15, to supply the anticipated contour progression θ, determined from the material flow model 7, and the actual contour progression θ of the metal strip 1 to a correction value calculator 21.

The correction value calculator 21 can, for example, vary one or both of the friction coefficients $\kappa_x$, $\kappa_z$, the latter by variation of the parameters, that determine the functional progression of the friction coefficients $\kappa_z$, by using the difference between the anticipated and actual contour progression θ, θ'. Alternatively, or as an addition, a variation can also be achieved by a comparison of the anticipated surface evenness progression s and the actual surface evenness progression s'.

By means of the method for determining in accordance with the invention and the associated devices, the heuristic correlations for present evenness rules in particular are replaced by a mathematical-physical material flow model 18 with an online capability, that models the deformation processes that occur in the roll gap. In this way, the properties of a contour progression and surface evenness control, such as accuracy, reliability and general applicability, can be significantly improved. Furthermore, the need for manual intervention (both during commissioning and during normal operation) is substantially reduced.

What is claimed is:

1. A computer-aided method for determining desired values for controlling elements of profile and surface evenness of a rolling stand having work rollers for rolling metal strip that extends in a direction of the strip width, the method comprising:

feeding input variables that describe the metal strip before and after passing through the rolling stand, to a material flow model;

determining at least one rolling force progression in the direction of the strip width by the material flow model;

feeding the at least one rolling force progression to a rolling deformation model;

determining rolling deformations using the rolling force progression by the rolling deformation model;

feeding the rolling deformations to a desired value calculator; and determining the desired values for the controlling elements of profile and surface evenness using the determined rolling deformations and a runout contour progression by the desired value calculator.

2. The method of determination in accordance with claim 1, wherein the material flow model determines a two-dimensional distribution of the rolling force, with one direction extending in the rolling direction and one direction extending in the direction of the strip width and wherein the material flow model determines the rolling force progression in the direction of the strip width by integration of the distribution of the rolling force in the rolling direction.

3. The method in accordance with claim 1, wherein the metal strip and the input variables are symmetrical in the direction of the strip width.

4. The method in accordance with claim 1, wherein the input variables comprise a starting contour progression, a final contour progression and a starting surface evenness progression.

5. The method in accordance with claim 1, wherein the material flow model determines the rolling force progression in the direction of the strip width with the aid of at least one mathematical-physical differential equation that describes the flow behavior of the metal strip in the rolling gap.

6. The method in accordance with claim 5, wherein the metal strip is rolled in the rolling stand in the rolling direction from a roll gap start over an effective roll gap length and that a rolling gap ratio is substantially less than one, with the roll gap ratio being the quotient of half of an initial strip thickness and the effective roll gap length.

7. The method in accordance with claim 5, wherein at least one differential equation takes account of only leading terms of the roll gap ratio.

8. The method in accordance with claim 5, wherein at least one differential equation is formed in such a way that all variables and parameters are dimensionless.

9. The method in accordance with claim 5, wherein the at least one differential equation is defined in the rolling direction and in the direction of the strip width at support points and wherein the support points are unevenly distributed.

10. The method in accordance with claim 9, wherein the support points are evenly distributed in the rolling direction.

11. The method in accordance with claim 9, wherein the support points in the direction of the strip width are closer together towards the edge of the strip than in the area of the center of the strip.

12. The method in accordance with claim 5, wherein the at least one differential equation comprises a coefficient of friction in the rolling direction and a coefficient of friction in the direction of the strip width, wherein the coefficient of friction is constant in the rolling direction and the coefficient of friction is a non-constant function in the direction of the strip width.

13. The method in accordance with claim 1, wherein the metal strip has a flow stress and that the flow stress is assumed to be constant with regard to the material flow model.

14. The method in accordance with claim 1, wherein only plastic deformations of the metal strip are taken into account by the material flow model.

15. The method in accordance with claim 1, wherein the material flow model also determines an expected runout-end evenness progression of the metal strip in the direction of the strip width.

16. The method in accordance with claim 1, wherein the rolling deformation model comprises a work roller flattening model and a rolling residual deformation model, wherein by the work roller flattening model a flattening progression of the work rollers to the metal strip is determined, wherein by the rolling residual deformation model the remaining deformations of the rollers of the rolling stand are determined, and wherein the rolling force progression is fed exclusively to the work roller flattening model.

17. The method in accordance with claim 1, wherein the material flow model is adapted using the rolled metal strip.

18. The method in accordance with claim 17, wherein at least one of the coefficients of friction is varied depending on the actual contour progression and the contour progression expected on the basis of the material flow model and/or at least one of the coefficients of friction is varied depending on the actual surface evenness progression and the surface evenness progression of the metal strip expected on the basis of the material flow model.

19. The method in accordance with claim 1, wherein the method is performed by a computer program product.

20. The method in accordance with claim 19, wherein the computer program product is loaded on a control computer for a rolling train having at least one rolling stand.

21. A rolling train, comprising:

a rolling stand; and a control computer adapted for performing a method for determining desired values for controlling elements of profile and surface evenness of a rolling stand having work rollers for rolling metal strip that extends in a direction of the strip width, the method comprising:

feeding input variables that describe the metal strip before and after passing through the rolling stand, to a material flow model;

determining at least one rolling force progression in the direction of the strip width by the material flow model;

feeding the at least one rolling force progression to a rolling deformation model;

determining rolling deformations using the rolling force progression by the rolling deformation model;

feeding the rolling deformations to a desired value calculator; and determining the desired values for the controlling elements of profile and surface evenness using the determined rolling deformations and a runout contour progression by the desired value calculator.

22. The rolling train according to claim 21, wherein the rolling train is a hot-rolling train for steel strip or aluminum strip.

23. The rolling train according to claim 21, wherein the rolling train is a multi-stand rolling train.

24. The rolling train according to claim 23, wherein the rolling train comprises at least three rolling stands.

* * * * *